US011131479B2

(12) United States Patent
Miyata et al.

(10) Patent No.: US 11,131,479 B2
(45) Date of Patent: Sep. 28, 2021

(54) AIR-CONDITIONING APPARATUS INDOOR UNIT

(71) Applicant: Mitsubishi Electric Corporation, Tokyo (JP)

(72) Inventors: Yoshinori Miyata, Tokyo (JP); Yasuyuki Kotake, Tokyo (JP); Yasutomo Hirai, Tokyo (JP); Takahiro Iinuma, Tokyo (JP); Yoshinori Fujii, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 50 days.

(21) Appl. No.: 16/093,755

(22) PCT Filed: May 31, 2016

(86) PCT No.: PCT/JP2016/066032
§ 371 (c)(1),
(2) Date: Oct. 15, 2018

(87) PCT Pub. No.: WO2017/208348
PCT Pub. Date: Dec. 7, 2017

(65) Prior Publication Data

US 2019/0120520 A1 Apr. 25, 2019

(51) Int. Cl.
*F24F 13/20* (2006.01)
*F24F 1/0047* (2019.01)
(Continued)

(52) U.S. Cl.
CPC ..... *F24F 13/20* (2013.01); *F24F 1/0047* (2019.02); *F24F 1/0063* (2019.02); *F24F 11/88* (2018.01);
(Continued)

(58) Field of Classification Search
CPC ..... F24F 13/20; F24F 11/88; F24F 1/0047; F24F 1/0063; F24F 13/222; F24F 13/22; F24F 2013/207; F24F 2221/14
(Continued)

(56) References Cited

U.S. PATENT DOCUMENTS 6,023,939 A * 2/2000 Correa ..... B01J 31/4038 62/298
10,054,320 B2 * 8/2018 Choi ..... F24F 11/89
(Continued)

FOREIGN PATENT DOCUMENTS

EP 2017544 A1 * 1/2009 ..... F24F 1/0007
JP S60-079628 U 6/1985
(Continued)

OTHER PUBLICATIONS

Takeshi, JP 4534668 B2, 2010, Original Document and English Translation of Description (Year: 2010).*
(Continued)

*Primary Examiner* — Joseph F Trpisovsky
(74) *Attorney, Agent, or Firm* — Posz Law Group, PLC

(57) ABSTRACT

An air-conditioning apparatus indoor unit on which maintenance work can be performed without removing a wire from a control box is provided. An air-conditioning apparatus indoor unit according to the present invention is an air-conditioning apparatus indoor unit to be embedded in an indoor ceiling surface. The indoor unit includes a housing, a heat exchanger installed in the housing, a drain pan installed below the heat exchanger, a wire extending into the housing from outside, and a control box connected with the wire in the housing and installed below the drain pan. The housing includes a cutout part at a lower end part of a side plate as a side surface of the housing, and a wire pass-through plate is detachably fitted to the cutout part. The wire
(Continued)

pass-through plate includes a hole through which the wire passes. The control box is adjacent to the wire pass-through plate.

8 Claims, 7 Drawing Sheets

(51) Int. Cl.
*F24F 11/88* (2018.01)
*F24F 1/0063* (2019.01)
*F24F 13/22* (2006.01)

(52) U.S. Cl.
CPC ..... *F24F 13/222* (2013.01); *F24F 2013/207* (2013.01); *F24F 2221/14* (2013.01)

(58) Field of Classification Search
USPC ..... 92/298; 62/298
See application file for complete search history.

(56) References Cited

U.S. PATENT DOCUMENTS

2002/0152760 A1* 10/2002 Okuda ..... F24F 1/0047 62/259.2
2010/0193164 A1* 8/2010 Wakatsuki ..... F24F 1/24 165/121
2015/0121943 A1 5/2015 Ishino
2015/0129179 A1* 5/2015 Moon ..... F24F 1/0007 165/121
2017/0045259 A1* 2/2017 Choi ..... F24F 1/0022
2019/0376733 A1* 12/2019 Pirmez ..... F24F 1/24

FOREIGN PATENT DOCUMENTS

JP H04-095218 U 8/1992
JP H06-011149 A 1/1994
JP H11-248190 A 9/1999
JP 2000-065385 A 3/2000
JP 2000-257905 A 9/2000
JP 2009-115360 A 5/2009
JP 2013-200092 A 10/2013
KR 20150062400 A * 6/2015

OTHER PUBLICATIONS

Yamashita JP 2010107140 A, 2010, Original Document and English Translation of Description (Year: 2010).*
Wataru, JP 2011153748 A, 2011 Original Document and English Translation of Description (Year: 2011).*
Michio, JP 2013024455 A, 2013, Original Document and English Translation of Description (Year: 2013).*
International Search Report of the International Searching Authority dated Aug. 30, 2016 for the corresponding International application No. PCT/JP2016/066032 (and English translation).
Office Action dated Jul. 30, 2019 issued in corresponding JP patent application No. 2018-520249 (and English translation).
Examination Report dated Sep. 16, 2020 issued in corresponding GB patent application No. 1817702.2.

* cited by examiner

AIR-CONDITIONING APPARATUS INDOOR UNIT

CROSS REFERENCE TO RELATED APPLICATION

This application is a U.S. national stage application of PCT/JP2016/066032 filed on May 31, 2016, the disclosure of which is incorporated herein by reference.

TECHNICAL FIELD

The present invention relates to an air-conditioning apparatus indoor unit to be embedded in a ceiling, and particularly relates to disposition of a control box housing a controller of the indoor unit and disposition of a wire connecting the control box with the outside.

BACKGROUND ART

A conventional air-conditioning apparatus indoor unit to be embedded in an indoor ceiling houses a heat exchanger, a fan, a drain pan, a control box, and other components in a housing. An indoor side surface of the housing is covered by a decorative plate to hide the internal structure of the indoor unit, thereby enhancing appearance. The indoor unit is connected with the outside through an on-site wire. The on-site wire includes a wire through which electrical power for operating the indoor unit is supplied from the outside and a communication line through which a signal or the like for controlling operation is sent. To perform repair or inspection in the housing, the decorative plate needs to be removed and work needs to be performed through a lower part of the housing embedded in the ceiling, which makes the work difficult.

For example, in an air-conditioning apparatus indoor unit disclosed in Patent Literature 1, the housing includes a cutout part on a side surface of the housing, and a closing plate is detachably attached to the cutout part. A round hole through which a wire is provided is opened in the closing plate. To perform repair and inspection inside the housing of the indoor unit, the closing plate is removed to increase a workspace.

CITATION LIST

Patent Literature

Patent Literature 1: Japanese Unexamined Patent Application Publication No. 6-11149

SUMMARY OF INVENTION

Technical Problem

According to Patent Literature 1, a workspace for repair, inspection, and replacement in the housing is obtained by removing the closing plate provided to the cutout part at the side surface of the housing. However, when the work space is obtained, repair, inspection, and replacement work of components in the air-conditioning apparatus indoor unit to be embedded in the ceiling still needs to be performed from below the housing, and the work needs to be performed at a high place, which imposes restrictions on the work. When it is difficult to perform work at the ceiling, a component needs to be removed so that work such as repair is performed at a place where the work can be easily performed. In particular, when the air-conditioning apparatus indoor unit has a small size, components in the housing of the indoor unit are disposed in the vertical direction, and thus a component at a lower place needs to be removed before a component at an upper place is removed. Moreover, a control box including a control board or the like, on which maintenance work such as repair tends to be frequently performed, is installed at a lower part in the housing. Thus, the control box needs to be removed before work such as repair is performed on a component in the indoor unit.

The control box is connected with an on-site wire for supplying power from the outside or the like, and thus the on-site wire needs to be disconnected from the control box before the control box is removed from the housing. However, to remove the on-site wire from the control box, a worker is required to have the qualification of the first-class electric works specialist, and thus a person who performs the removal work is limited to such specialists.

To remove the control box from the housing without removing the on-site wire from the control box, the length of the on-site wire needs to have allowance. When the length of the on-site wire has allowance (hereinafter referred to as an "allowance length"), the part of the allowance length needs to be housed in a space outside of the indoor unit above the surface of the indoor ceiling, or needs to be housed in the housing of the indoor unit. When the allowance length of the on-site wire is housed in the space outside of the housing of the indoor unit, the one-side wire cannot have an allowance length depending on an environment in which the indoor unit is installed. When the allowance length of the on-site wire is housed in the housing of the indoor unit, the on-site wire needs to be housed in such a long length in the housing, which imposes restrictions on structure in the housing, such as disposition of the control box.

The present invention has been attained in order to solve the above-described problems, and is aiming at providing an air-conditioning apparatus indoor unit having a structure that allows a control box to be removed from a housing without work on an on-site wire connected with a terminal table or a board in the control box. The present invention also provides an air-conditioning apparatus indoor unit that does not require a structure in which an on-site wire is housed in a long length in a housing, and thus allows a heat exchanger, a fan, a drain pan, and a control box in the housing to be efficiently disposed to achieve downsizing.

Solution to Problem

An air-conditioning apparatus indoor unit according to an embodiment of the present invention is an air-conditioning apparatus indoor unit to be embedded in an indoor ceiling surface. The indoor unit includes: a housing; a heat exchanger installed in the housing; a drain pan installed below the heat exchanger; a wire extending into the housing from the outside; and a control box connected with the wire in the housing and installed below the drain pan. The housing includes a cutout part at a lower end part of a side plate as a side surface of the housing, and a wire pass-through plate is detachably fitted to the cutout. The wire pass-through plate includes a hole through which the wire passes. The control box is disposed adjacent to the wire pass-through plate.

Advantageous Effects of Invention

According to an embodiment of the present invention, when work such as repair is performed on an air-conditioning apparatus indoor unit, a control box can be removed while being connected with an on-site wire, and the control box can be removed from a housing without being affected by an environment in which the indoor unit is installed. Moreover, the control box is disposed adjacent to a wire pass-through plate, and the on-site wire is not housed in a long length in the housing. This configuration eliminates the need to provide a space for housing the allowance length of the on-site wire, thereby relaxing restrictions on disposition of a heat exchanger, a fan, a drain pan, and other components. As a result, the air-conditioning apparatus indoor unit can be downsized.

DESCRIPTION OF EMBODIMENTS

Figure 1:
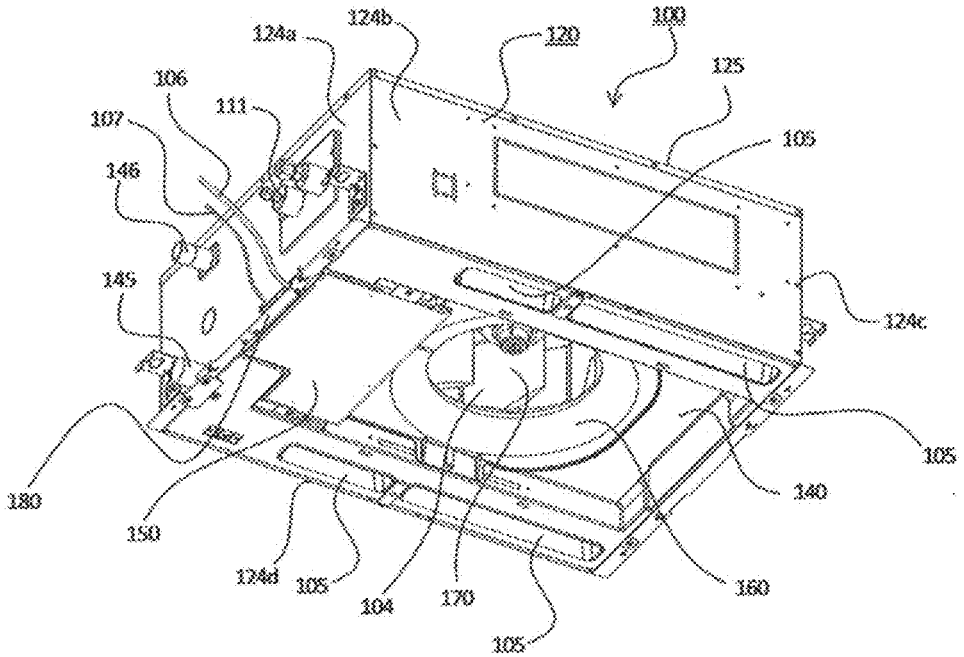
FIG. 1 is a perspective view of an indoor unit according to Embodiment 1 of the present invention.

Embodiments of the present invention will be described below with reference to the accompanying drawings. In the drawings, for example, instruments denoted by an identical reference sign are identical or equivalent, and this notation applies throughout the specification. Configurations of components described in the specification are merely exemplary, and thus the present invention is not limited to those described in the specification. In particular, combinations of components are not limited only to those in each embodiment, and components described in an embodiment are applicable to another embodiment. Furthermore, for example, a plurality of instruments of the same kind that are distinguished by suffixes are written without the suffixes in some cases when not particularly needed to be distinguished or specified. In the drawings, the relation between the sizes of components may differ from the actual ones.

Embodiment 1

FIG. 1 is a perspective view of an indoor unit 100 according to Embodiment 1 of the present invention. In Embodiment 1, the indoor unit 100 is an air-conditioning apparatus indoor unit at least partially embedded in an indoor ceiling. Embodiment 1 describes below the indoor unit 100 of a two-direction cassette type including air outlets 105 in two directions. The indoor unit 100 in Embodiment 1 includes a fan 170. The indoor unit 100 is connected with an outdoor unit through a refrigerant pipe to achieve a refrigerant circuit configured to perform air-conditioning or the like while circulating refrigerant.

The indoor unit 100 includes a housing 120 including an instrument configured to perform air circulation or the like. The housing 120 includes a top plate 125 and side plates 124*a* to 124*d*, and has an opening on a side facing indoors, in other words, a lower side. The side plates 124*a* to 124*d* of the housing 120 surround four side surfaces 144*a* to 144*d* of a drain pan 140 that is rectangular in plan view. The top plate 125 of the housing 120 is attached to upper ends of the side plates 124*a* to 124*d*. A decorative panel (not illustrated) is attached to the opening of the housing 120. The decorative panel faces indoors as a target space of air conditioning or the like. A grille (not illustrated) as an air inlet of air (gas) into the indoor unit 100 is provided at a central part of the decorative panel. Air having passed through the grille is de-dusted through a filter (not illustrated).

The following describes a configuration in the housing 120. As illustrated in FIG. 1, a bell mouth 160 is installed upstream of the fan 170 on an air inflow side of the indoor unit 100. The bell mouth 160 rectifies air having flowed into through the grille and sends the air to the fan 170.

Figure 2:
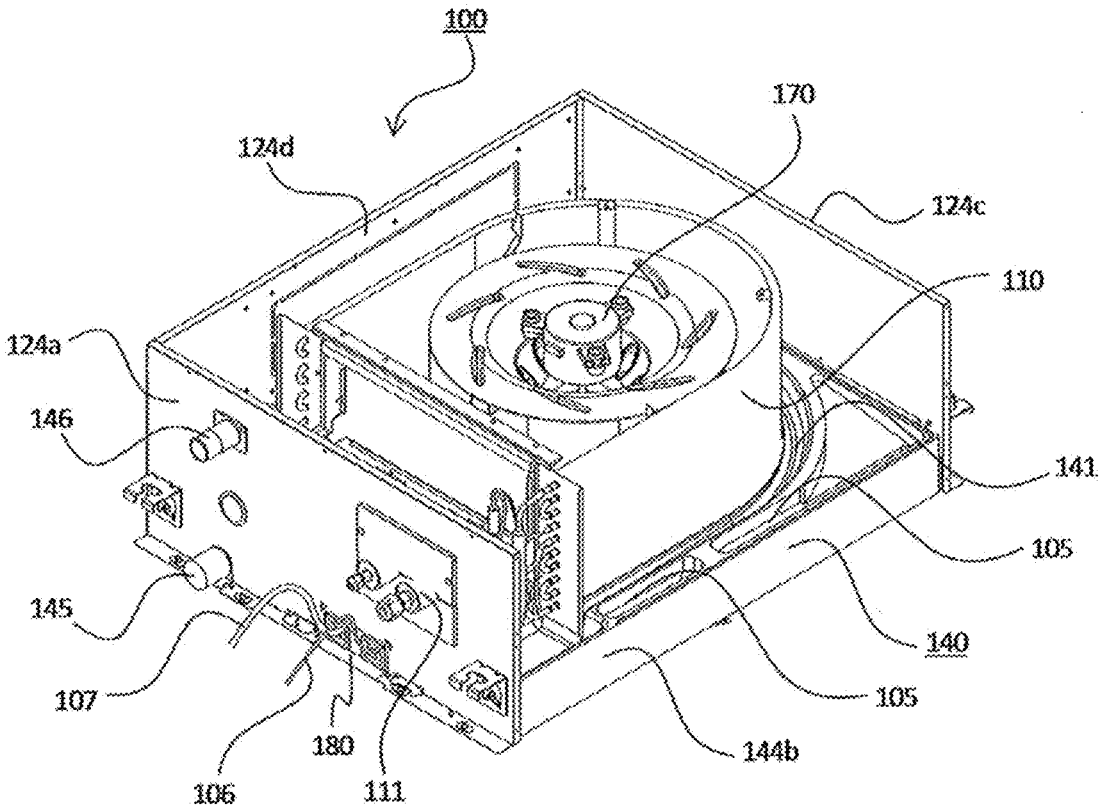
FIG. 2 is a perspective view illustrating an internal configuration of the indoor unit in FIG. 1.
Figure 3:
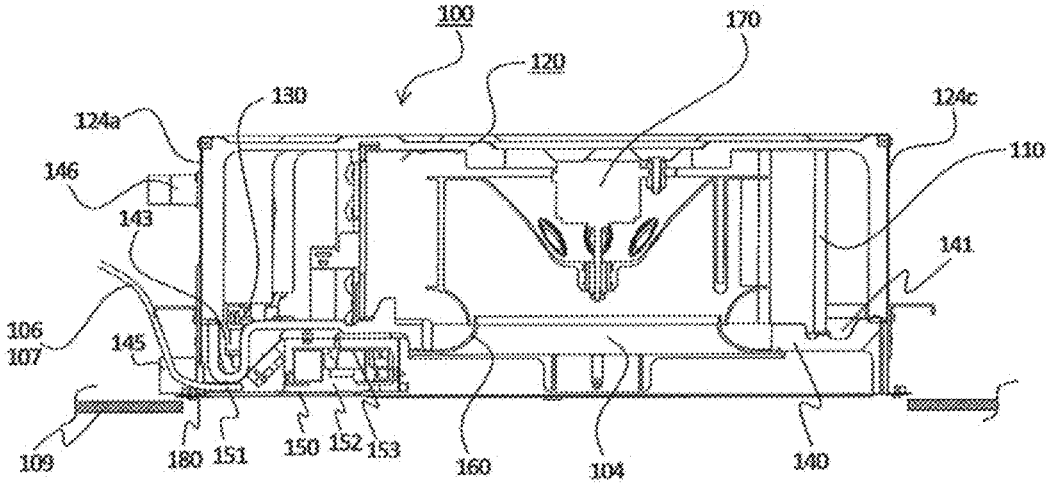
FIG. 3 is a sectional view of the indoor unit in FIG. 1.

FIG. 2 is a perspective view for explaining an internal configuration of the indoor unit 100 in FIG. 1. FIG. 3 is an illustration of a section of the indoor unit 100 in FIG. 1. FIG. 2 is a top view of the indoor unit 100 in a state in which the side plates 124*a* to 124*d* and the top plate 125 of the housing 120 are removed. For example, an indoor heat exchanger 110 of a fin tube type is installed downstream of the fan 170 in air flow, surrounding the fan 170. For example, when the indoor unit 100 of Embodiment 1 is applied to an air-conditioning apparatus, the indoor heat exchanger 110 functions as an evaporator at cooling operation, and functions as a condenser at heating operation.

The drain pan 140 is disposed below the indoor heat exchanger 110 and provided with a groove 141 along the indoor heat exchanger 110. The groove 141 is provided along a lower end part of the indoor heat exchanger 110 to collect drain water generated from the indoor heat exchanger 110. The drain pan 140 is formed of, for example, synthetic resin. The drain pan 140 includes, at a central part of a lower surface of the indoor unit 100, an air inlet 104 around which the bell mouth 160 is attached and through which air having flowed in through the grille passes. The drain pan 140 also includes through-holes as the air outlets 105 through which air having flowed out of the indoor heat exchanger 110 passes. The air outlets 105 are communicated with the bell mouth 160, forming an air path in the indoor unit 100.

A control box 150 is disposed in the opening port in a lower surface of the housing 120. The control box 150 is disposed below the drain pan 140, avoiding the air inlet 104 opened downward at the central part of the lower surface of the indoor unit 100 and the bell mouth 160 attached around the air inlet 104. The control box 150 is disposed adjacent to the side plate 124*a*. As illustrated in FIG. 3, the housing 120 of the indoor unit 100 of Embodiment 1 is installed higher than an indoor ceiling 109. Thus, when a worker approaches close to the ceiling 109 and performs maintenance work such as inspection and repair inside the indoor unit 100 while facing upward, since the control box 150 is disposed at a lower part of the housing 120, maintenance work inside the control box 150 can be easily performed from below the indoor unit 100, which is an advantage.

Figure 4:
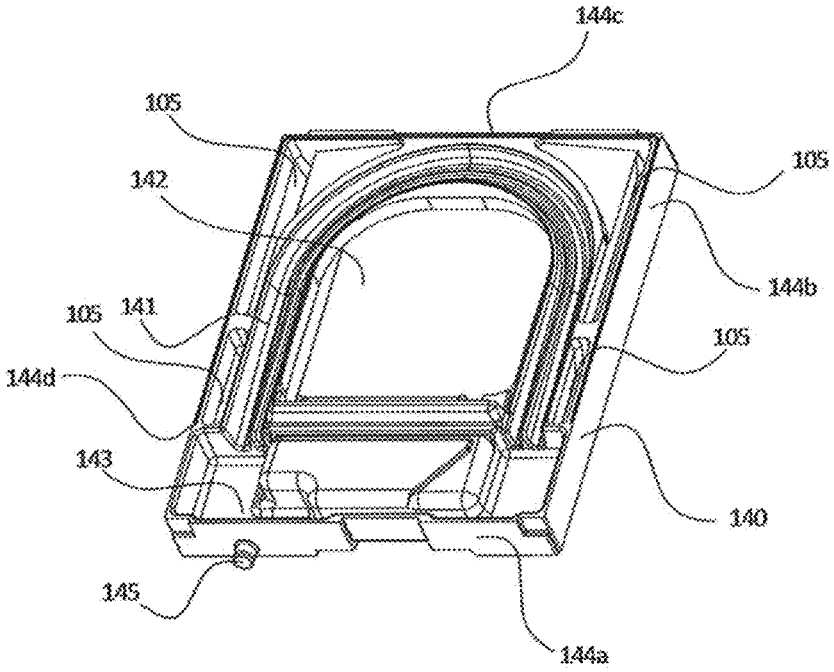
FIG. 4 is a perspective view of a drain pan installed in the indoor unit in FIG. 1 when viewed from above.
Figure 5:
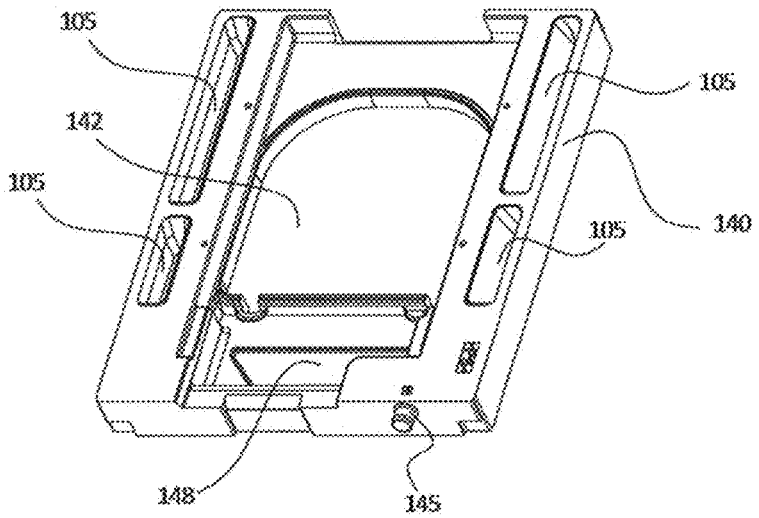
FIG. 5 is a perspective view of the drain pan in FIG. 4 when viewed from below.

FIG. 4 is a perspective view of the drain pan 140 installed in the indoor unit 100 in FIG. 1 when viewed from above. FIG. 5 is a perspective bottom view of the drain pan 140 in FIG. 4. The drain pan 140 includes an opening port 142 at a central part. The air inlet 104 is formed by attaching the bell mouth 160 to the opening port 142. The groove 141 is formed around the opening port 142 on an upper surface of the drain pan 140. The groove 141 covers the lower end part of the indoor heat exchanger 110 from below and has a U-shaped section.

In Embodiment 1, the indoor heat exchanger 110 is provided in a U shape around the air inlet 104 and the fan 170. Accordingly, the groove 141 of the drain pan 140 is disposed in a U shape in plan view. Both ends of the groove 141 are connected with a water collection container 143. The water collection container 143 has a depth larger than that of the groove 141. Accordingly, the water collection container 143 has a bottom surface lower than that of the groove 141. The bottom surface of the groove 141 is tilted toward the water collection container 143 from a position farthest from the water collection container 143 so that water having fallen onto the groove 141 flows toward the water collection container 143.

The water collection container 143 is disposed nearer to the side plate 124*a* of the housing 120 in the indoor unit 100 and disposed along the side plate 124*a*. A discharge port 145 is provided to the side surface 144*a* of the drain pan 140 on which the water collection container 143 is disposed. Water accumulated in the water collection container 143 is discharged out of the housing 120 through the discharge port 145. A drain-up mechanism 130 is installed at the water collection container 143 to suck up water accumulated in the water collection container 143 and discharge the water out of the indoor unit 100 through a discharge port 146.

In Embodiment 1, a central part of the water collection container 143 protrudes from the bottom surface thereof when the drain pan 140 is viewed from above. As illustrated in FIG. 5, the central part of the water collection container 143 is recessed upward when viewed from a lower surface side of the drain pan 140 so that the control box 150 is housed in this recess 148.

In Embodiment 1, as illustrated in FIG. 1, the air outlets 105 are provided along, among the side surfaces 144 of the drain pan 140, the two facing side surfaces 144*b* and 144*d* adjacent to the side surface 144*a* on a side on which the water collection container 143 is installed. The air outlets 105 vertically penetrate the drain pan 140.

Figure 6:
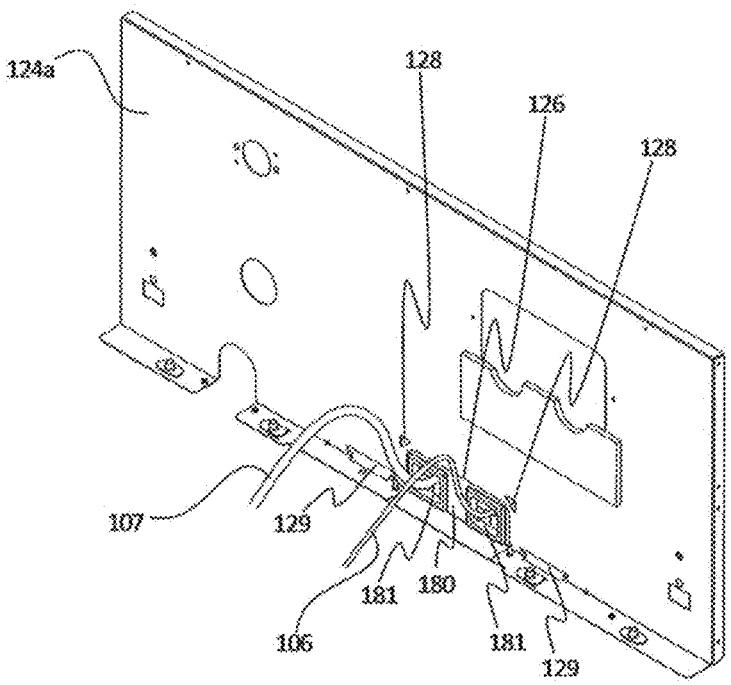
FIG. 6 is an illustration of a side plate of a housing of the indoor unit according to Embodiment 1.

FIG. 6 is an illustration of the side plate 124*a* of the housing 120 of the indoor unit 100 according to Embodiment 1. FIG. 6 illustrates the side plate 124*a* and a part through which a wire extends from the outside, and illustration of the other parts is omitted. The side plate 124*a* is provided with an opening port through which a connection unit 111 for a refrigerant pipe, the discharge port 145 for drain water, and the discharge port 146 for drain water sucked by the drain-up mechanism 130 are disposed. The side plate 124*a* is also provided with a wire pass-through plate 180 as a part through which a wire extends from the outside into the housing. The wire pass-through plate 180 is detachably fitted to a cutout part 126 provided at a lower end part of the side plate 124*a*. The side plate 124*a* is also provided with, above the cutout part 126, a fixation groove 128 into which an upper end corner of the wire pass-through plate 180 is inserted. The fixation groove 128 forms a recessed part from the outside to inside of the side plate 124*a*, and the recessed part is provided with a hole so that the upper end corner of the wire pass-through plate 180 can be inserted from below. Due to the fixation groove 128, the wire pass-through plate 180 is detachably fixed along an inner surface of the side plate 124*a*. The lower end part of the side plate 124*a* is bent toward the outside of the housing to form a flange-shaped part. The wire pass-through plate 180 has a flange-shaped part at a lower end part so that the flange-shaped part of the side plate 124*a* and the flange-shaped part of the wire pass-through plate 180 are vertically placed over and fastened by screws. The fixation of the side plate 124*a* and the wire pass-through plate 180 is not limited to fastening by screws but may be achieved by, for example, locking to a groove provided to the side plate 124*a*.

A wire 107 is a power source line through which power is supplied to the indoor unit 100 from the outside. A wire 106 is a communication line that is connected with, for example, a remote controller and through which a signal is transferred to the indoor unit 100 from the outside. The wires 106 and 107 each extend into the indoor unit 100 through a through-hole provided to the wire pass-through plate 180. A bush 181 made of, for example, rubber is fitted to the wire pass-through plate 180. The bush 181 has a thin recessed central part and is provided with, at this thin part, a cross-shaped slit through which the wire 106 or 107 can pass. The cross-shaped slit provided to the bush 181 follows an outer peripheral surface of the wire 106 or 107, and thus no gap is likely to generate when the wire 106 or 107 passes through the slit, thereby suppressing entering of, for example, dust and bug from the outside. The cross-shaped slit provided to the bush 181 allows the wires 106 and 107 to pass through the bush 181. The bush 181 provided to the wire pass-through plate 180 reduces air inflow into the housing 120 or air outflow out of the housing 120. The slit provided to the bush 181 is not limited to a cross shape but may be a slit only in the longitudinal direction or the lateral direction.

The wires 106 and 107 each extend from, for example, a wiring pipe provided above the ceiling 109 of a room in which the indoor unit 100 is installed, into the indoor unit 100. The distance from the wiring pipe to the indoor unit 100 differs depending on an environment in which the indoor unit 100 is installed.

As illustrated in FIG. 3 and the like, the control box 150 is disposed adjacent to the wire pass-through plate 180. The control box 150 includes a wire introducing unit 151 through which the wires 106 and 107 extend into the control box 150, and a control board housing part 152 housing a control board 153 for controlling the fan 170 and other components. The wire introducing unit 151 is positioned on the inner side of the housing 120 relative to the wire pass-through plate 180 fitted to the cutout part 126 of the side plate 124*a* of the housing 120. The wire introducing unit 151 is positioned at a height substantially the same as that of the hole of the wire pass-through plate 180 through which the wires 106 and 107 passes. In other words, the wire introducing unit 151 is positioned adjacent to the wire pass-through plate 180. The water collection container 143 of the drain pan 140 is disposed above the wire introducing unit 151. The control board housing part 152 is provided on a side of the wire introducing unit 151 closer to a central part of the housing 120. The wire introducing unit 151 and the control board housing part 152 are provided side by side above a lower surface plate 154 as a lower surface of the control box 150, and formed in such shapes that allows the control box 150 to be disposed along the shape of the drain pan 140 disposed above the control box 150. The control board housing part 152 is positioned beside the water collection container 143. A region beside the water collection container 143 in FIG. 3 is recessed upward from a bottom surface of the water collection container 143, thereby forming the recess 148 illustrated in FIG. 5. The control board housing part 152 is housed in the recess 148.

The lower surface of the control box 150 is disposed not to protrude from the lower surface of the housing 120. The wires 106 and 107 extend into the control board housing part 152 along the lower surface plate 154 of the control box 150. In other words, the wires 106 and 107 extend into the control board housing part 152 through a space between the lower surface plate 154 of the control box 150 and the water collection container 143. The wires 106 and 107 are fixed to a terminal table inside the control board housing part 152.

The control board 153 is disposed along an upper surface plate 155 of the control board housing part 152 while a component mounting surface 153*a* on which each component of an electric circuit is mounted faces downward. This configuration eliminates the need to remove the control box 150 from the housing 120 when performing maintenance of the control board 153. A maintenance worker only needs to remove the lower surface plate 154 of the control box 150 to visually recognize the wire introducing unit 151 and the control board housing part 152 and also visually recognize the component mounting surface 153*a* of the control board 153. Since the control board 153 is disposed along the upper surface plate 155 of the control box 150, heat is likely to be transferred to the upper surface plate 155. Furthermore, the heat can be transferred from the upper surface plate 155 to a structure component of the housing 120 or a component in the housing 120. In Embodiment 1, only the single control board 153 is provided as illustrated in FIG. 3, but the control board may be configured as a plurality of separate boards.

Figure 7:
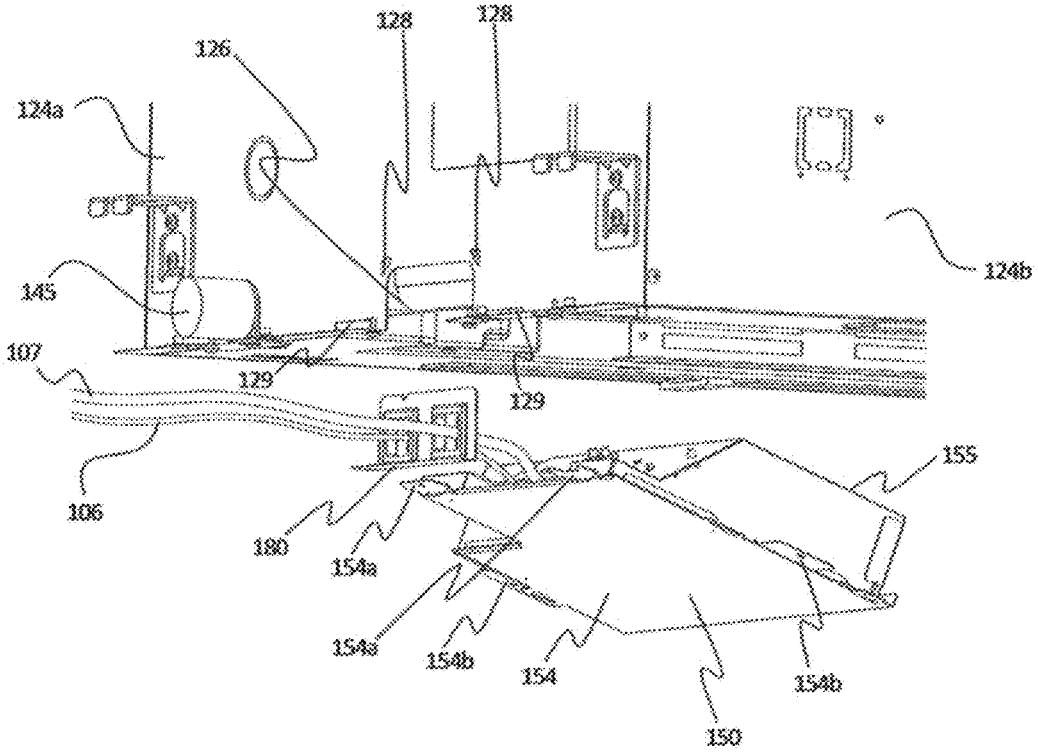
FIG. 7 is an illustration of a state in which a control box is removed from the indoor unit in FIG. 1.

FIG. 7 is an illustration of a state in which the control box 150 is removed from the indoor unit 100 in FIG. 1. FIG. 7 is an enlarged view of the surroundings of the control box 150. In Embodiment 1, the control box 150 is fixed to the flange-shaped part of the side plate 124*a* and the lower surface of the drain pan 140. Holes 129 are opened on both sides of the cutout part 126 of the side plate 124*a*. Fixation pieces 154*a* protrude at an end part of the lower surface plate 154 of the control box 150 on a side closer to the side plate 124*a*. The fixation pieces 154*a* are inserted into the holes 129 so that the fixation pieces 154*a* are placed on an upper surface of the flange-shaped part of the side plate 124*a*. In addition, fixation pieces 154*b* protrude at two sides parallel to a direction in which the wires 106 and 107 extend, on an end face of the lower surface plate 154. The fixation pieces 154*b* are fixed to the lower surface of the drain pan 140 by screws. To remove the control box 150 from the indoor unit 100, the screws fixing the fixation pieces 154*b* are removed, and the fixation pieces 154*a* are pulled out of the holes 129. Accordingly, the control box 150 is displaced toward the center of the housing 120 to be removed from the housing 120.

As illustrated in FIGS. 2 and 3, the wire introducing unit 151 is disposed adjacent to the side plate 124*a*. Thus, when there is no allowance length in the lengths of the wires 106 and 107, the fixation pieces 154*a* and 154*b* fixing the control box 150 can be removed but the fixation pieces 154*a* contact with a structure at a lower end of the side plate 124*a* near the hole of the wire pass-through plate 180, which makes it difficult to move the control box 150 from below the drain pan 140. In Embodiment 1, however, the restriction of the wires 106 and 107 by the side plate 124*a* is avoided by allowing the wire pass-through plate 180 to be removed from the side plate 124*a*. Accordingly, the wires 106 and 107 can be moved downward from the lower end of the side plate 124*a*, and the control box 150 does not contact with the structure at the lower end of the side plate 124*a*, which results in such an increased movable range of the control box 150 that the control box 150 can be moved from below the drain pan 140.

Figure 8A:
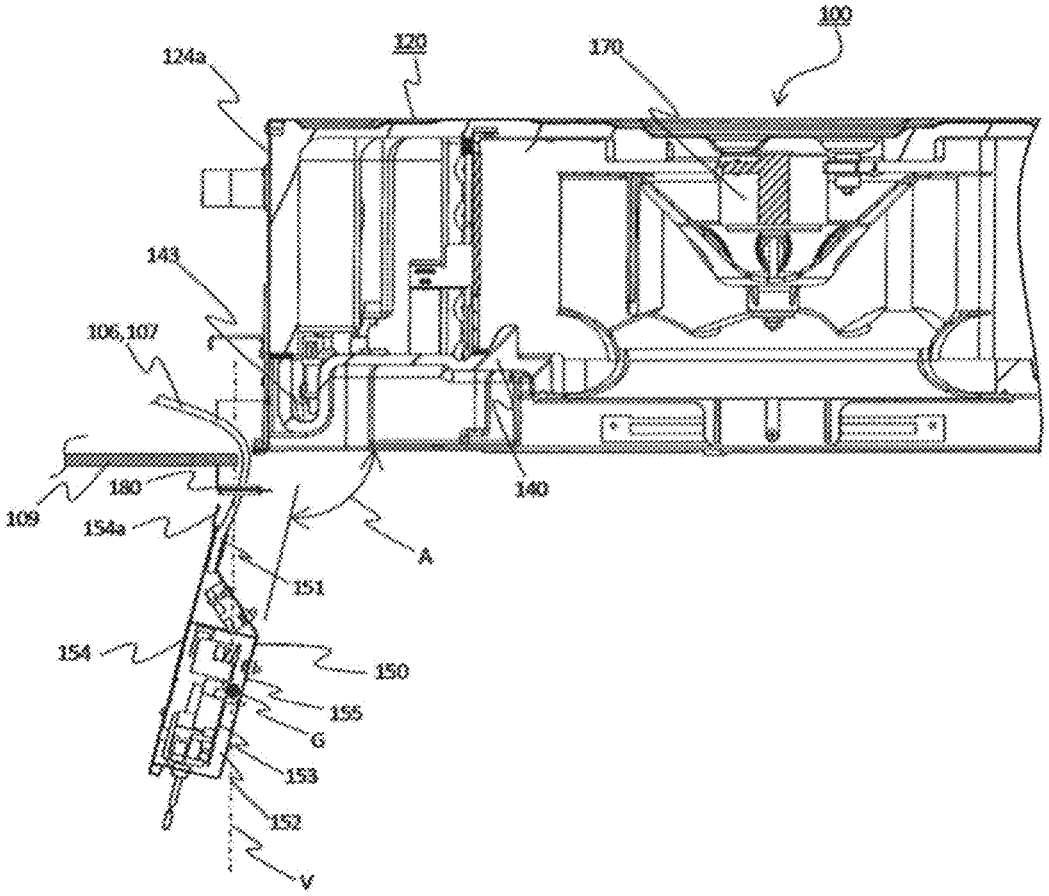
FIG. 8A is an illustration of a state in which the control box is moved from below the drain pan in the indoor unit in FIG. 1.
Figure 8B:
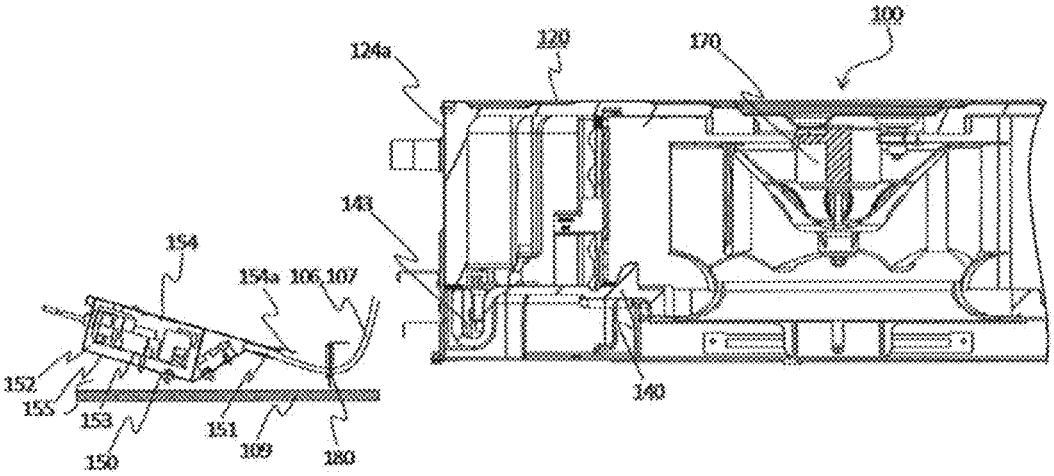
FIG. 8B is an illustration of a state in which the control box is moved from below the drain pan in the indoor unit in FIG. 1.

FIGS. 8A and 8B are illustrations of a state in which the control box 150 is moved from below the drain pan 140 in the indoor unit 100 in FIG. 1. In FIG. 8A, the control board housing part 152 has a height from the lower surface plate 154 higher than that of the wire introducing unit 151, and the control board 153 is disposed on the upper surface plate 155 side, and thus the control box 150 has a center of gravity G on the upper surface plate 155 side. Thus, when the control box 150 is suspended by the wires 106 and 107, the center of gravity G of the control box 150 is positioned directly below a pivot supporting the wires 106 and 107, which is an end part of the ceiling 109 in FIG. 8A. In other words, the center of gravity G is positioned on a vertical line V passing through the end part of the ceiling 109. Accordingly, when the control box 150 and the wire pass-through plate 180 are removed from the housing 120 and suspended by the wires 106 and 107 as illustrated in FIG. 8A, the angle between the lower surface of the housing 120 and the upper surface plate 155 of the control box 150 is larger than 90 degrees. With this configuration, for example, when work is performed to remove the drain pan 140 from the indoor unit 100, the control box 150 can be suspended off a position directly below the drain pan 140, and thus does not encumber the work of removing the drain pan 140.

As illustrated in FIG. 8B, after being removed from the housing 120, the control box 150 can be placed on the ceiling 109. With this configuration, the control box 150 can be moved further to a position at which work is not encumbered, thereby facilitating work at repair and inspection of the indoor unit 100. In addition, the control box 150 illustrated in FIG. 8B can be more stably placed than being suspended, which leads to higher safety at work and less load on the wires.

Since the control box 150 has a configuration in which the wire introducing unit 151 is positioned lower and the control board housing part 152 is positioned higher as described above, and the wire introducing unit 151 can be disposed adjacent to the side plate 124*a*, avoiding the water collection container 143 protruding at a lower part of the drain pan 140. Thus, the water collection container 143 can be disposed at a position along the side plate 124*a* at which water accumulated in the drain pan 140 can be easily discharged, and the control board 153 can be disposed beside the water collection container 143. With this configuration, the control board 153 and the water collection container 143 can be disposed side by side at the same height in the vertical direction of the housing 120, which allows reduction of the dimension of the housing 120 in the vertical direction.

(Effects of Embodiment 1)

(1) The air-conditioning apparatus indoor unit 100 of Embodiment 1 is the air-conditioning apparatus indoor unit 100 embedded in an indoor ceiling surface. The indoor unit 100 includes: the housing 120; the indoor heat exchanger 110 installed in the housing 120; the drain pan 140 installed below the indoor heat exchanger 110; the wires 106 and 107 extending into the housing 120 from the outside; and the control box 150 connected with the wires 106 and 107 in the housing 120 and installed below the drain pan 140. The housing 120 includes the cutout part 126 formed at an end part of the side plate 124*a*, and the wire pass-through plate 180 that is detachably fitted to the cutout part 126 and through which the wires 106 and 107 penetrate. The control box 150 is disposed adjacent to the wire pass-through plate 180.

With this configuration, the control box 150 is disposed at a position at which maintenance work such as repair and inspection can be easily performed. When maintenance work is performed on a component disposed above the control box 150, the control box 150 can be removed from the housing 120 and moved from below the drain pan 140. In this case, the movable range of the control box 150 is not restricted by the wires 106 and 107 also when the wires 106 and 107 are not removed from the control box 150. This eliminates the need to remove the wires 106 and 107 from the control box 150 at maintenance work, and thus a worker without the qualification of the first-class electric works specialist can perform maintenance work.

(2) In the air-conditioning apparatus indoor unit 100 of Embodiment 1, the control box 150 includes the control board 153 provided with an electric component on the component mounting surface 153*a*, and the control board 153 is installed in the control box 150 with the component mounting surface 153*a* facing downward.

With this configuration, when maintenance work is performed only on the control board 153, the work can be performed by removing only the lower surface plate 154 of the control box 150, to thereby facilitate the work.

(3) In the air-conditioning apparatus indoor unit 100 of Embodiment 1, the drain pan 140 includes the water collection container 143 protruding downward, and the water collection container 143 is disposed along the side plate 124*a* including the cutout part 126. The control box 150 has an escape shape for avoiding the water collection container 143. The control board 153 is disposed beside the water collection container 143 at the same height as that of the water collection container 143 in the vertical direction of the housing 120.

With this configuration, the control board 153 and the water collection container 143 are disposed side by side at the same height in the vertical direction of the housing 120, which allows reduction of the dimension of the housing 120 in the vertical direction.

(4) In the air-conditioning apparatus indoor unit 100 of Embodiment 1, the drain pan 140 includes the water collection container 143 protruding downward. The water collection container 143 is disposed along the side plate 124*a* including the cutout part 126. The control box 150 includes the wire introducing unit 151 in which the wires 106 and 107 are disposed along the lower surface plate 154 as the lower surface of the control box 150, and the control board housing part 152 housing the control board 153. The wire introducing unit 151 has a height from the lower surface of the control box 150 lower than that of the control board housing part 152, and is disposed below the water collection container 143. The control board housing part 152 is disposed beside the water collection container 143.

This configuration provides similar effects as those provided by the above-described (3).

(5) In the air-conditioning apparatus indoor unit 100 of Embodiment 1, the control box 150 has the center of gravity G on an upper surface side of the control box 150.

With this configuration, for example, when work is performed to remove the drain pan 140 from the indoor unit 100, the control box 150 can be suspended off a position directly below the drain pan 140, and thus does not encumber the work of removing the drain pan 140.

Embodiment 2

An air-conditioning apparatus indoor unit 200 according to Embodiment 2 of the present invention is different from the air-conditioning apparatus indoor unit 100 according to Embodiment 1 in that the control box 150 can be removed from the housing 120 without removing an internal wire 108 in the housing 120 from the control box 150. Embodiment 2 mainly describes differences of the indoor unit 200 from that of Embodiment 1. Each component of the indoor unit 200 according to Embodiment 2 in the drawings, which has a function identical to that in Embodiment 1 is denoted by a reference sign identical to that in the drawings used in the description of Embodiment 1.

Figure 9:
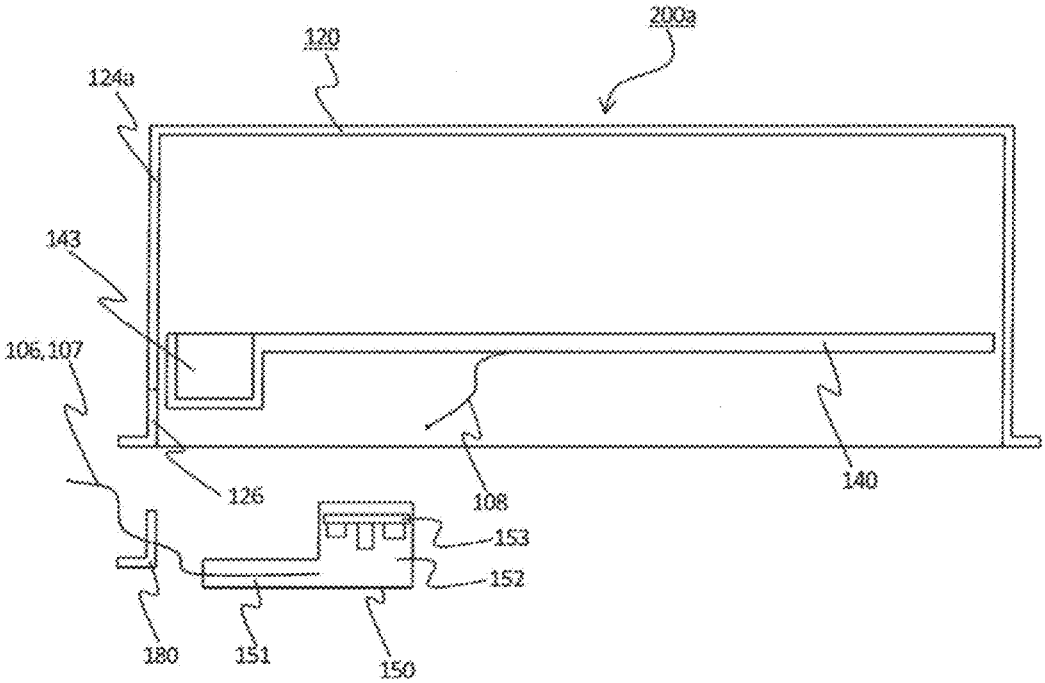
FIG. 9 is a sectional view illustrating an indoor unit as a comparative example.

FIG. 9 is an illustration of a section of an indoor unit 200*a* as a comparative example. FIG. 9 schematically illustrates the section of the indoor unit 200*a*, omitting part of the internal structure thereof, but the omitted part has a structure the same as that of the indoor unit 100 of Embodiment 1. In the indoor unit 200*a*, the internal wire 108 is positioned near the center of the housing 120. Thus, when the control box 150 is removed from the housing 120, the internal wire 108 connected with the control box 150 needs to be removed. The internal wire 108 connects the control board 153 in the control box 150 with the fan 170 and the drain-up mechanism 130 installed in the housing 120.

Figure 10:
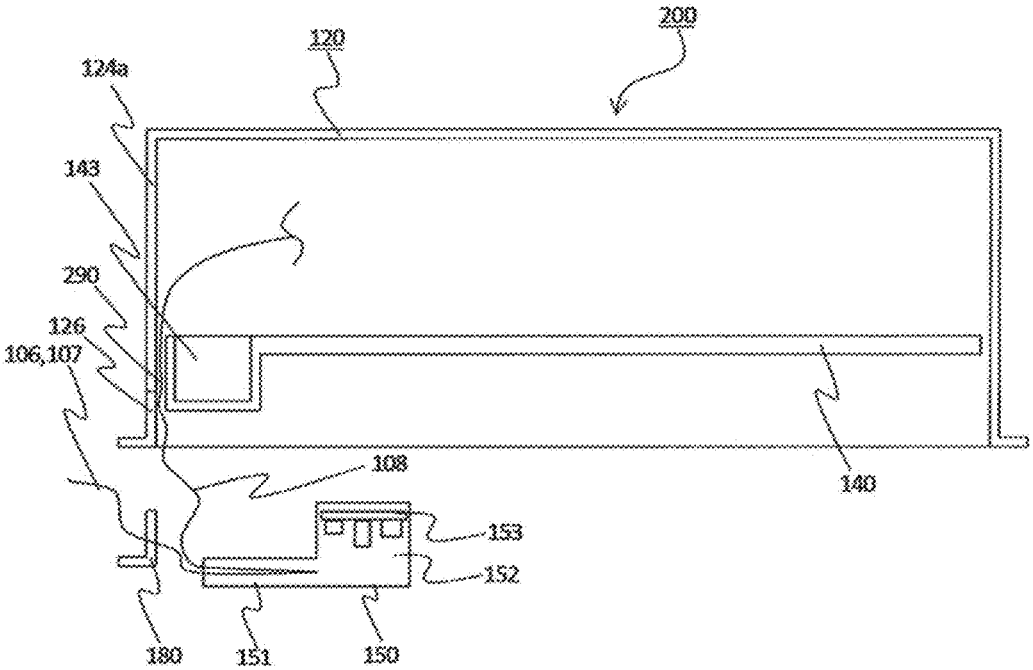
FIG. 10 is a sectional view illustrating an air-conditioning apparatus indoor unit according to Embodiment 2 of the present invention.

FIG. 10 is an illustration of a section of the air-conditioning apparatus indoor unit 200 according to Embodiment 2 of the present invention. Like FIG. 9, FIG. 10 schematically illustrates the section of the indoor unit 200, omitting part of the internal structure thereof, but the omitted part has a structure the same as that of the indoor unit 100 of Embodiment 1. In the indoor unit 200, the internal wire 108 extends through the wire introducing unit 151 of the control box 150 and is introduced to an upper part of the drain pan 140 through a gap 290 between the water collection container 143 of the drain pan 140 and the side plate 124*a*. The gap 290 is provided between the drain pan 140 and the side plate 124*a*, but may be formed by, for example, providing a recess at part of an end face of the drain pan 140. Since the gap 290 is disposed adjacent to the wire pass-through plate 180, the movable range of the control box 150 is not restricted by the internal wire 108 when the control box 150 is removed from the housing 120, as in the case of Embodiment 1. However, the internal wire 108 needs to have an allowance length. Specifically, the internal wire 108 needs to have an allowance length that allows the control box 150 to be moved to a position at which the control box 150 does not contact with the side plate 124*a*.

(Effects of Embodiment 2)

(6) The air-conditioning apparatus indoor unit 200 of Embodiment 2 further includes the internal wire 108. The internal wire 108 connects, through the gap 290 between the water collection container 143 and the side plate 124*a*, the control box 150 with the fan 170, the drain-up mechanism 130, and the other components disposed above the drain pan 140 in the housing 120. The fan 170, the drain-up mechanism 130, and other components correspond to electric components of the present invention.

With this configuration, the indoor unit 200 allows the control box 150 to be moved from below the drain pan 140 without removing the internal wire 108 from the control box 150. Accordingly, a worker can perform maintenance work in the housing 120, avoiding the control box 150, without work of removing the internal wire 108.

Embodiment 3

An air-conditioning apparatus indoor unit 300 according to Embodiment 3 of the present invention is different from the air-conditioning apparatus indoor unit 100 according to Embodiment 1 in that the control box 150 and the wire pass-through plate 180 are integrated. Embodiment 3 mainly describes differences of the indoor unit 300 from that of Embodiment 1. Each component of the indoor unit 300 according to Embodiment 3 in the drawings, which has a function identical to that in Embodiment 1 is denoted by a reference sign identical to that in the drawings used in the description of Embodiment 1.

Figure 11:
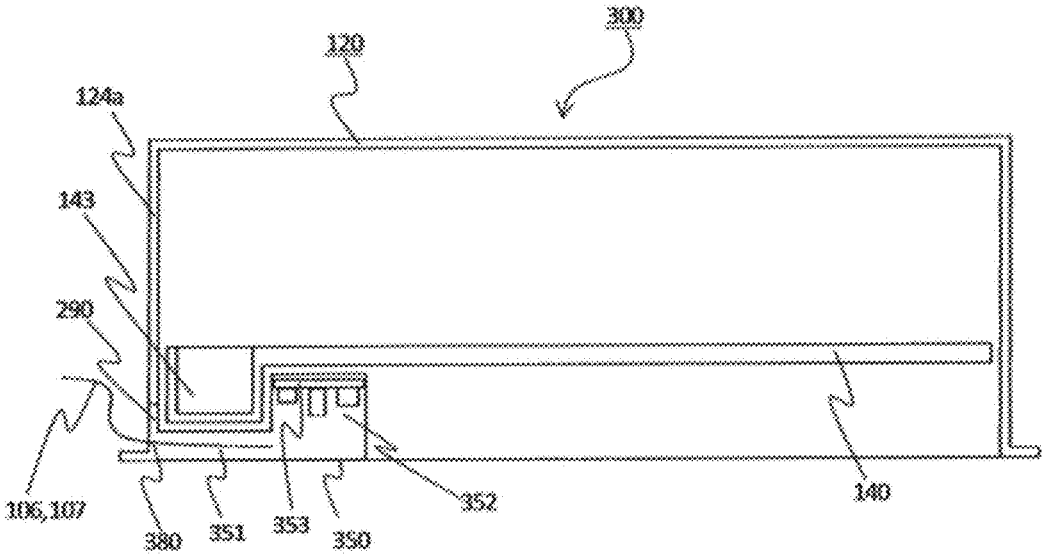
FIG. 11 is a sectional view illustrating an air-conditioning apparatus indoor unit according to Embodiment 3 of the present invention.
Figure 12:
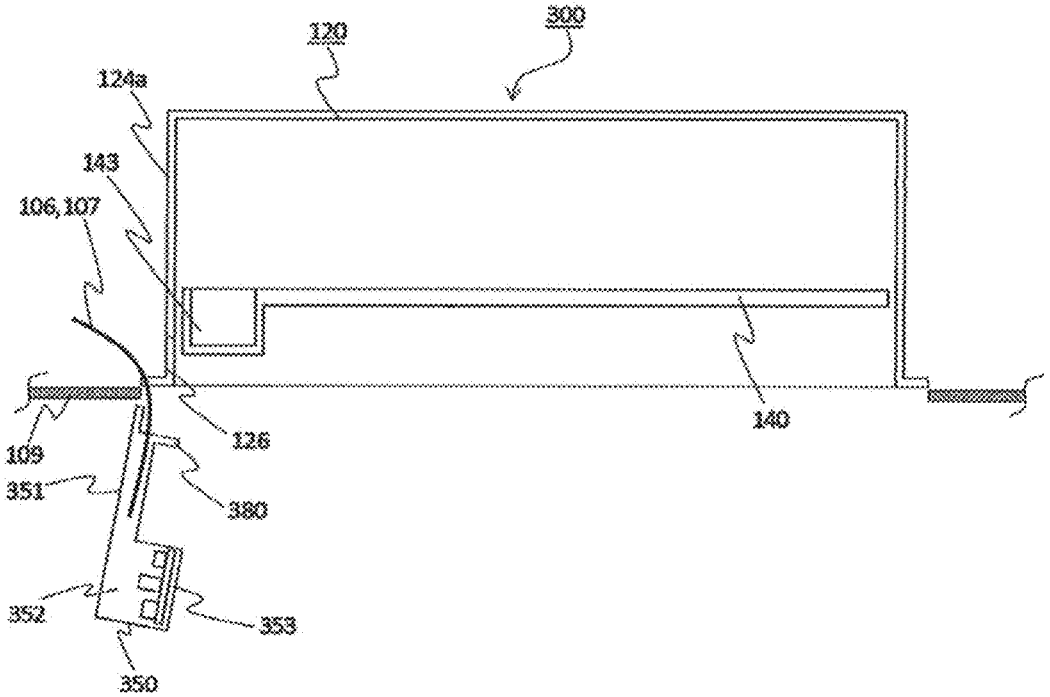
FIG. 12 is an illustration of a state in which a control box is removed from the indoor unit in FIG. 11.

FIG. 11 is an illustration of a section of the air-conditioning apparatus indoor unit 300 according to Embodiment 3 of the present invention. FIG. 12 is an illustration of a state in which a control box 350 is removed from the indoor unit 300 in FIG. 11. FIGS. 11 and 12 each schematically illustrate the section of the indoor unit 300, omitting part of the internal structure thereof, but the omitted part has the same structure as that of the indoor unit 100 of Embodiment 1. The control box 350 of the indoor unit 300 is integration of the control box 150 and the wire pass-through plate 180 of Embodiment 1. Thus, when the control box 350 is removed from the housing 120, a wire pass-through plate 380 is removed together. The wires 106 and 107 pass through the wire pass-through plate 380 in advance before the control box 350 is attached to the indoor unit 300 when the indoor unit 300 is installed, and then are attached to the indoor unit 300.

As in the indoor unit 200 of Embodiment 2, the internal wire 108 may be disposed through a space between the water collection container 143 of the drain pan 140 and the side plate 124*a*. The wire may be disposed on a side closer to the central part of the housing 120 as in the indoor unit 200*a*, but in such a case, the internal wire 108 needs to be removed from the control box 150 when the control box 150 is removed.

(Effects of Embodiment 3)

(7) In the air-conditioning apparatus indoor unit 300 of Embodiment 3, the wire pass-through plate 380 is formed integrally with the control box 350.

With this configuration, the indoor unit 300 includes a reduced number of components and fastening by screws or the like is performed at a reduced number of places, which simplifies the work of removing the control box 350. In addition, at attachment of the control box 350, a reduced number of components need to be attached, which simplifies work.

REFERENCE SIGNS LIST

100 indoor unit 104 air inlet 105 air outlet 106 wire 107 wire

108 internal wire 109 ceiling 110 indoor heat exchanger 111 connection unit 120 housing 124*a* side plate 124*b* side plate 124*c* side plate 124*d* side plate 125 top plate 126 cutout part 128 fixation groove 129 hole

130 drain-up mechanism 140 drain pan 141 groove 142 opening port 143 water collection container 144*a* side surface 144*b* side surface

144*c* side surface 144*d* side surface 145 discharge port 146 discharge port 148 recess 150 control box 151 wire introducing unit 152 control board housing part 153 control board 153*a* component mounting surface 154 lower surface plate 154*a* fixation piece 154*b* fixation piece

155 upper surface plate 160 bell mouth 170 fan 180 wire pass-through plate 181 bush 200 indoor unit 200*a* indoor unit 290 gap 300 indoor unit

350 control box 380 wire pass-through plate G center of gravity V vertical line

The invention claimed is:

1. An air-conditioning apparatus indoor unit to be embedded in an indoor ceiling surface, the air-conditioning apparatus indoor unit comprising:

a housing;

a heat exchanger installed in the housing;

a drain pan installed below the heat exchanger;

a wire extending into the housing from outside; and a control box connected with the wire in the housing and installed below the drain pan, wherein the housing includes a cutout part in a lower end part of a side plate, which forms an exterior side surface of the housing, and a wire pass-through plate detachably fitted to the cutout part, the wire pass-through plate includes a hole through which the wire passes, and the control box is located adjacent to the wire pass-through plate, wherein a lower surface plate of the control box has protrusions that engage with the side plate so that the side plate supports the lower surface plate, and the protrusions are configured to be disengaged from the side plate to allow the control box to separate from a remainder of the indoor unit if the control box is displaced toward a center of the housing.

2. The air-conditioning apparatus indoor unit of claim 1, wherein the wire pass-through plate is formed integrally with the control box.

3. The air-conditioning apparatus indoor unit of claim 1, wherein the control box includes a control board provided with a component of an electric circuit on a component mounting surface, and the control board is installed in the control box with the component mounting surface facing downward.

4. The air-conditioning apparatus indoor unit of claim 3, wherein the drain pan includes a water collection container protruding downward, the water collection container is located along the side plate including the cutout part, the control box has an escape shape for avoiding the water collection container, and the control board is located beside the water collection container, wherein the control board is horizontally aligned with the water collection container.

5. The air-conditioning apparatus indoor unit of claim 3, wherein the drain pan includes a water collection container protruding downward, the water collection container is located along the side plate including the cutout part, a section of the wire is located along the lower surface plate as a lower surface of the control box, the control box includes a control board housing part that houses the control board, the section of the wire has a height from the lower surface of the control box and is located below the water collection container, the height being lower than a height of the control board housing part from the lower surface of the control box, and the control board housing part is located beside the water collection container.

6. The air-conditioning apparatus indoor unit of claim 4, further comprising an internal wire, wherein the internal wire connects, through a gap between the water collection container and the side plate, the control box with an electric component located above the drain pan in the housing.

7. The air-conditioning apparatus indoor unit of claim 3, wherein the control box has a center of gravity on an upper surface side of the control box.

8. The air-conditioning apparatus indoor unit of claim 5, further comprising an internal wire, wherein the internal wire connects, through a gap between the water collection container and the side plate, the control box with an electric component located above the drain pan in the housing.

* * * * *